US006325866B1

(12) United States Patent
Fortunati et al.

(10) Patent No.: US 6,325,866 B1
(45) **Date of Patent: *Dec. 4, 2001**

(54) PROCESS FOR THE PRODUCTION OF GRAIN ORIENTED SILICON STEEL SHEET

(75) Inventors: Stefano Fortunati, Ardea; Stefano Cicale', Rome; Giuseppe Abbruzzese, Montecastrilli, all of (IT)

(73) Assignee: Acciai Speciali Terni S.p.A., Terni (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/331,504

(22) PCT Filed: Jul. 24, 1997

(86) PCT No.: PCT/EP97/04005

§ 371 Date: Jun. 22, 1999

§ 102(e) Date: Jun. 22, 1999

(87) PCT Pub. No.: WO98/28451

PCT Pub. Date: Jul. 2, 1998

(30) Foreign Application Priority Data

Dec. 24, 1996 (IT) ..... RM96A0905

(51) Int. Cl.[7] ..... H01F 1/04

(52) U.S. Cl. ..... 148/113; 148/111; 148/230; 148/221; 148/231

(58) Field of Search ..... 148/111, 113, 148/230, 221, 231

(56) References Cited

U.S. PATENT DOCUMENTS

| | | | | |
|---|---|---|---|---|
| 5,266,129 | * | 11/1993 | Minakuchi et al. | 148/113 |
| 5,472,521 | * | 12/1995 | Yoshitomi et al. | 148/111 |
| 5,507,883 | * | 4/1996 | Tanaka et al. | 148/113 |
| 5,512,110 | * | 4/1996 | Yoshitomi et al. | 148/113 |
| 5,597,424 | * | 1/1997 | Yoshitomi et al. | 148/111 |
| 5,643,370 | * | 7/1997 | Huppi | 148/111 |
| 5,679,178 | * | 10/1997 | Komatsubara et al. | 148/113 |
| 5,759,293 | * | 6/1998 | Takahashi et al. | 148/111 |
| 5,759,294 | * | 6/1998 | Bolling et al. | 148/111 |
| 5,800,633 | * | 9/1998 | Inokuti | 148/111 |
| 5,885,371 | * | 3/1999 | Komatsubara et al. | 148/113 |

* cited by examiner

*Primary Examiner*—Roy King
*Assistant Examiner*—Nicole Coy
(74) *Attorney, Agent, or Firm*—Hedman & Costigan, P.C.

(57) ABSTRACT

A process for the production of grain oriented silicon steel sheet which provides an optimization of the production of conventional, grain oriented silicon steel strips, by the use of an appropriate synergistic combination of the composition levels of some elements and appropriate treatments which result in the control of the presence and type of inhibitors, and by so doing, controlling the primary-recrystallization grain size.

8 Claims, No Drawings

PROCESS FOR THE PRODUCTION OF GRAIN ORIENTED SILICON STEEL SHEET

The present application is the national stage filing of and claims priority to International Application No. PCT/EP97/04005, filed Jul. 24, 1997 and Italian Application Serial No. RM96A000905, filed Dec. 24, 1996.

1. Field of Invention

The present invention refers to a process for the production of grain oriented silicon steel sheet, and more precisely refers to a process that enables optimization of the production of grain oriented silicon steel strips, of a conventional type, via an appropriate synergistic combination between the specific choice of the composition levels of some elements and appropriate treatments enabling to control presence and type of inhibitors, and hence the primary-recrystallization grain size, as well as the secondary recrystallization conditions.

2. Prior Art

Silicon steel sheets are used basically for the manufacture of electric transformer cores.

Silicon steel consists of many adjacent to one another, grains having a cubic body-centred lattice where the axes corresponding to the corners of the cube, crystallographically designated by [100], constitute directions of easy magnetization.

Given:

(i) the structure of transformer cores, consisting of stacks of magnetic laminations made from silicon steel strip cut parallel with respect to the length of the rolled strip and combined to form a torus, and (ii) the working scheme of the transformers themselves, in which the passage of current in the primary winding induces a magnetic flux in the core, which propagates through the core itself, it is evident how the work necessary for the magnetic flux to propagate is a function of the resistance that it encounters, and hence it is evident how the axes [100] must be parallel to the rolling direction of the strip, and hence to its length. In addition, it is obvious that it is not possible to have all the grains oriented exactly in the optimal way described above, and hence that big efforts have had to be made to reduce the degree of disorientation of the grains.

Furthermore, it is necessary to maintain the number and size of such grains within certain limits, which are well-known to those expert in the field.

Only by respecting these general conditions is it possible to obtain a material having good magnetization characteristics, among which magnetic permeability, expressed as density of magnetic flux caused in the core by a magnetic field of a given value, and dissipation of energy during operation, usually referred to as core losses at given frequency and permeability, and expressed in W/kg.

Correct orientation of the grains in the end product is obtained during a thermal treatment called secondary-recrystallization annealing, in which the growth only of the crystals originally having the desired orientation is possible. The number and orientation of the final grains depend to a certain extent on the corresponding initial values.

The grain growth process is activated by heat and is due to the fact that certain crystals, which for kinetic or energetic reasons are more "energized" than others, start growing at the expense of the adjacent crystals, at a temperature lower than is the one at which the other crystals are activated, thus reaching earlier the critical size that enables them to predominate in the growth process.

However, as is well known, the production process of grain oriented silicon steel sheet involves numerous heating cycles at high temperatures, during some of which grain growth could start, which, if it were to occur in not appropriate ways or times, would not allow the desired end results to be achieved.

Secondary recrystallization is controlled by some compounds, such as manganese suiphide, manganese selenide, aluminium nitride, etc., which, when appropriately precipitated in the steel, inhibit grain growth until they are solubilized, thus enabling initiation of secondary recrystallization. The higher the solubilization temperature of these compounds (also called inhibitors), the better their capacity to control grain growth, and the better the quality of the end product. Oriented-grain silicon steel for electrical applications is generically classified into two categories, basically differentiated by the levels of the magnetic induction value, expressed in mT, measured under the action of a magnetic field having the value of 800 amp-turn/m, designated with the code B800: the category of conventional grain oriented silicon steel, the so-called OG, with B800 values of up to approximately 1880 mT, and that of super-oriented grain silicon steel, with B800 values of over 1900 mT.

Conventional grain oriented silicon steel, introduced in the thirties, uses as inhibitors essentially manganese sulphides and/or selenides, whereas super-oriented grain silicon steel uses essentially aluminium-based nitrides, containing also other elements, such as silicon. For the sake of simplicity of presentation, hereinafter we shall refer to these inhibitors as aluminium nitrides.

The use of aluminium nitrides has enabled the achievement of very high-quality results, but has also entailed certain production problems due, to a large extent, to the following requirements:

higher carbon content;

higher reduction rate in cold-rolling;

adopting necessary precautions to maintain, from the hot-rolling phase to the final secondary-recrystallization annealing phase, two types of inhibitors simultaneously, namely sulphides and aluminium nitrides, in the optimal size and distribution for achieving the desired results.

Also in the production of conventional grain oriented silicon steel, difficulties are encountered in controlling the size and distribution of the inhibitors, even though at less extreme levels than in the case of the higher-quality product.

However, the production of a good-quality grain oriented silicon steel sheet is complex and costly, and it is evident how it is necessary to apply in a particularly careful way all possible techniques to enable reduction of production costs.

Consequently, in the production of conventional grain oriented silicon steel sheet, aluminium is not used in that it is considered an element that adversely affects the magnetic characteristics of the product because it forms undesired oxide precipitates, and the complications that it introduces into the process raise the cost of the treatment to an absolutely unacceptable extent.

This Applicant, which is one of the leading producers in Europe of steels for electrical applications, since a long time has been studying solutions aimed at optimizing the production and quality of grain oriented silicon steels, both in the category of super-oriented grain steels and in that of conventional grain oriented steels. In particular, for the latter type of product, the applicant has studied methods for eliminating, or in any case reducing, the critical aspects of the production process.

In previous patent applications, processes have been proposed in which silicon steel undergoes continuous casting to form a thin flat bloom, typically having a thickness of 40–70 mm, to exploit the favourable solidification structure which presents a preponderance of the so-called monodirectional small-sized grains, and the fine and well-distributed structure of the second phases, i.e., of the precipitates that inhibit grain growth. In addition, a concept that had been expressed in numerous patents of Japanese origin has been adopted, according to which it is possible to ignore completely the necessity to obtain a fine and well-distributed precipitate starting from the initial phases of the process; on the contrary the precipitates obtained during steel solidification have to remain as coarse as possible, whilst the precipitates necessary to control the secondary-recrystallization process are advantageously obtained during the slow heating phase preceding the above-mentioned secondary recrystallization.

This Applicant, however, has noticed that, in this way, during most of the process it is necessary to proceed in a particularly controlled way to prevent an uncontrolled grain growth, due to the fact that practically no suitable inhibitors are present. Consequently, this Applicant has introduced a radical innovation consisting in that, during heating of the slabs, a temperature is reached that is required for the solubilization of a limited, but significant, quantity of inhibitor that is strictly necessary to enable the various thermal treatments to be carried out in a not excessively controlled way, and new inhibitor to be generated by means of specific treatments, which are simpler and more direct than those known to the prior art. The purpose of the present invention is that of enabling utilization of the above concepts in the production of conventional grain oriented silicon steel sheet, rationalizing the production cycle and optimizing product quality.

DESCRIPTION OF THE INVENTION

According to the present invention, an appropriate combination in cooperation relationship is adopted between the specific choice of the composition levels of some elements and appropriate treatments in order to control presence and type of inhibitors, and hence the primary-recrystallization grain size, as well as the secondary re-crystallization conditions.

In particular, the present invention refers to a process for the preparation of grain oriented silicon steel strips, in which a steel having a desired composition is produced in the molten state and continuously cast to form slabs, which are sent to the hot-rolling station, after intermediate heating at high temperature, and then hot-rolled to obtain a strip of the desired thickness, the strip being coiled, and the coils are subsequently unwound and cold-rolled to the desired final thickness, the cold-rolled strip thus obtained then undergoing the final treatments which include primary-recrystallization annealing and secondary-recrystallization annealing, said process being characterized by the combination in cooperation relationship of the following operations:

a) continuous casting of slabs having the following composition: 2.5% to 3.5% bw of Si; from 50 to 500 ppm of C; from 250 to 450 ppm of $Al_{sol}$; less than 120 ppm of N; from 500 to 3000 ppm of Cu; and from 500 to 1500 ppm of Sn, the remainder consisting of iron and minor impurities;

b) bringing slabs to a temperature of between 1200° C. and 1320° C.;

c) hot-rolling the slabs, heated as described above, to a thickness of between 1.8 and 2.5 mm, ensuring a time of exposure to air of the strip coming out of the finishing roll train of at least 4 s. at a temperature of between 1000° C. and 900° C., and coiling the strip at a temperature of between 550° C. and 700° C.;

d) single-stage cold-rolling the strip down to the final thickness;

e) carrying out continuous decarburization annealing in a wet nitrogen-hydrogen atmosphere, at a temperature of between 850° C. and 950° C. for a period of time of between 20 s. and 150 s., and subsequently carrying out, again continuously, nitriding annealing at a temperature of between 900° C. and 1050° C., in a nitrogen-hydrogen atmosphere containing volumes of $NH_3$ ranging from 1 to 35, preferably from 1 to 9, standard litres per kg of strip, and containing from 0.5 to 100 g/m$^3$ of water vapour. Preferably, the steel composition includes from 100 to 300 ppm of C, from 300 to 350 ppm of $Al_{sol}$ and from 60 to 90 ppm of N.

Heating of the strip during the subsequent secondary recrystallization in the interval between 700° C. and 1200° C. takes place in a period of time of at least 2 hours, preferably between 2 and 10 hours.

It is important to note how the process according to the present invention makes it possible not to control in a particularly strict way the content of trace elements, thus enabling the use of less expensive raw materials. In particular, according to the present invention, there may be present such elements as chromium, nickel, and molybdenum, in overall quantities not exceeding 3500 ppm.

The heating temperature for the slabs is preferably between 1250° C. and 1300° C. In addition, the hot-rolled steel strip is cooled with water, starting from 4–12 s. after its exit from the finishing roll stand.

The present invention will now be illustrated in a number of examples, which, however, are mere illustrations and do not limit the possibilities and range of application of the invention itself.

EXAMPLE 1

Slabs (having the following composition in weight: Si, 3.12%; C, 230 ppm; Mn, 730 ppm; S, 80 ppm; $Al_{sol}$, 320 ppm; N, 82 ppm; Cu, 1000 ppm; Sn, 530 ppm; Cr, 200 ppm; Mo, 100 ppm; Ni, 400 ppm, P, 100 ppm; and Ti, 20 ppm; the remainder consisting of iron and minor impurities) were brought to a temperature of 1260° C. and then hot-rolled to a thickness of 2.2 mm.

One half of the strips underwent cooling in water starting from less than 2 s. after their exit from the finishing stand, whilst the remaining strips underwent delayed cooling, starting from approximately 6 after their exit from the last finishing stand. The coiling temperature of the strips was in each case kept within the 650–670° C. range.

The hot-rolled strips were first sandblasted and pickled, and then cold-rolled to thicknesses of between 0.30 and 0.23 mm. Subsequently, they underwent continuous decarburization annealing in a nitrogen-hydrogen atmosphere with a dew point of 68° C. for 90 sec. at 800° C., followed by nitriding annealing for 15 sec. at 960° C. in a nitrogen-hydrogen atmosphere containing $NH_3$ with a dew point of 15° C., with the purpose of introducing into the strips an amount of nitrogen of between 80 and 140 ppm, according to the thicknesses.

The strips thus obtained were coated with MgO-based annealing separator and coiled; next, they underwent box-annealing, with rapid heating up to 700° C., were left to stand for 15 hours at this temperature, and then heated up to 1200° C. at a rate of 30° C./h, and finally allowed to cool off freely. Table 1 below shows the results obtained.

TABLE 1

| Cooling delay (sec.) | Final thickness (mm) | B800 (mT) | P17 (W/kg) | P15 (W/kg) |
|---|---|---|---|---|
| <2 | 0.29 | 1855 | 1.25 | 0.87 |
| <2 | 0.26 | 1840 | 1.21 | 0.82 |
| <2 | 0.23 | 1795 | 1.43 | 0.86 |
| 8 | 0.29 | 1870 | 1.18 | 0.85 |
| 8 | 0.26 | 1875 | 1.16 | 0.79 |
| 8 | 0.22 | 1870 | 0.99 | 0.67 |

EXAMPLE 2

A number of castings having different compositions were produced, as shown in Table 2.

TABLE 2

| Casting | Si % | C ppm | Mn ppm | S ppm | Cu ppm | $Al_{sol}$ ppm | N ppm | Cr ppm | Ni ppm | Mo ppm | Sn ppm | Ti ppm |
|---|---|---|---|---|---|---|---|---|---|---|---|---|
| A | 3.1 | 130 | 1300 | 70 | 300 | 230 | 80 | 100 | 400 | 100 | 200 | 20 |
| B | 3.2 | 200 | 700 | 80 | 1500 | 290 | 70 | 500 | 400 | 200 | 700 | 10 |
| C | 3.0 | 250 | 850 | 70 | 2300 | 310 | 80 | 400 | 300 | 200 | 1000 | 10 |
| D | 3.3 | 190 | 1000 | 100 | 100 | 300 | 90 | 300 | 500 | 300 | 300 | 10 |
| E | 2.9 | 90 | 1200 | 80 | 2000 | 320 | 80 | 500 | 600 | 100 | 900 | 20 |
| F | 3.1 | 230 | 900 | 120 | 1200 | 260 | 100 | 400 | 400 | 200 | 1200 | 20 |
| G | 3.2 | 270 | 1200 | 70 | 2800 | 300 | 80 | 1800 | 2500 | 1500 | 1500 | 20 |

The slabs were brought to a temperature of 1250° C., cogged to 40 mm, and hot-rolled to 2.2–2.3 mm. The strips were then cold-rolled to a thickness of 0.26 mm. The cold-rolled strips next underwent decarburization at 870° C. and nitriding at 1000° C. The cycle was completed by coating strips with MgO-based annealing separator and final static annealing with fast heating to 700° C., standing for 10 hours, heating up to 1210° C. at a rate of 40° C./h in nitrogen 30%-hydrogen, standing for 15 hours in pure hydrogen, and finally cooling. The results obtained are shown in Table 3.

TABLE 3

| Casting | B800 (mT) | P17 (W/kg) | P15 (W/kg) |
|---|---|---|---|
| A | 1710 | 1.66 | 0.97 |
| B | 1875 | 1.15 | 0.78 |
| C | 1880 | 1.08 | 0.76 |
| D | 1845 | 1.26 | 0.83 |
| E | 1870 | 1.13 | 0.78 |
| F | 1690 | 1.78 | 1.03 |
| G | 1595 | 2.08 | 1.33 |

EXAMPLE 3

A casting having a composition of Si 3.25% in weight, C 100 ppm, Mn 850 ppm, S 70 ppm, Cu 1500 ppm, $Al_{sol}$ 310 ppm, Cr+Ni+Mo 1200 ppm underwent hot-rolling as per Example 1, and cooling of the resultant strips was initiated after 8 seconds from the moment when the strips came out of the finishing stand. The strips then underwent cold-rolling to a thickness of 0.22 mm.

On one of the strips, different decarburization and nitriding conditions were tested; results obtained after static annealing with a fast temperature rise up to 650° C., 15-hour standing, increase in heating up to 1200° C. at a rate of 100° C./h in nitrogen 25%-hydrogen, 20-hour standing in hydrogen, and cooling, were measured.

Table 4 gives the testing conditions and shows the results obtained.

TABLE 4

| Decarburiz. Temp. (° C.) $pH_2O/pH_2$ = 0.58 | Nitriding temp. (° C.) $pH_2O/pH_2$ = 0.05 | Magnetic induction B800 (mT) |
|---|---|---|
| 820 | 750 | 1673 |
| 820 | 900 | 1751 |
| 820 | 1000 | 1832 |
| 870 | 750 | 1595 |
| 870 | 900 | 1849 |
| 870 | 1000 | 1870 |
| 930 | 750 | 1630 |
| 930 | 900 | 1860 |
| 930 | 1000 | 1850 |

TABLE 4-continued

| Decarburiz. Temp. (° C.) $pH_2O/pH_2$ = 0.58 | Nitriding temp. (° C.) $pH_2O/pH_2$ = 0.05 | Magnetic induction B800 (mT) |
|---|---|---|
| 970 | 750 | 1579 |
| 970 | 900 | 1820 |
| 970 | 1000 | 1810 |

The remaining strips were treated according to the following cycle: (i) continuous decarburization for 100 s. at a temperature of 870° C. in nitrogen 25%-hydrogen with a dew point of 41° C., and (ii) continuous nitriding for 20 sec. at a temperature of 980° C. in nitrogen-hydrogen atmosphere with variable concentrations of $NH_3$ and a dew point of 10° C.

The results obtained, after coating with MgO-based annealing separator and box anealing are given in Table 5 below.

TABLE 5

| Strip No. | Nitrogen fed in (ppm) | B800 (mT) | P17 (W/kg) | P15 (W/kg) |
|---|---|---|---|---|
| 1 | 54 | 1860 | 1.06 | 0.72 |
| 2 | 48 | 1840 | 1.14 | 0.73 |
| 3 | 142 | 1870 | 1.03 | 0.68 |
| 4 | 156 | 1868 | 1.01 | 0.64 |
| 5 | 148 | 1872 | 1.05 | 0.70 |
| 6 | 345 | 1860 | 1.12 | 0.72 |
| 7 | 352 | 1855 | 1.09 | 0.72 |

What is claimed is:

1. In a process for the production of grain oriented silicon steel in which a steel is produced in the molten state and is continuously cast to form slabs which are sent to a hot rolling station after intermediate heating at high temperature, and thereafter are hot-rolled to obtain a strip of the desired thickness, the strip being coiled and subsequently uncoiled and cold rolled to the desired final thickness, subjecting the cold rolled strip thus produced to final treatments including primary-recrystallization annealing and secondary-recrystallization annealing the improvement which consists essentially of:

(a) continuously casting slabs having the following composition; 2.5% to 3.5% by weight of Si; from 50 to 500 ppm of C; from 250 to 450 ppm of $Al_{sol}$; less than 120 ppm of N; from 500 to 3000 ppm of Cu; and from 500 to 1500 ppm of Sn, the remainder consisting of iron and other impurities;

(b) bringing said continuously cast slabs to a temperature of between 1200° C. and 1320° C.;

(c) hot rolling the slabs of step (b) to a thickness of between 1.8 and 2.5 mm, ensuring a time of exposure to air of the strip coming from the finishing stand of at least 4 seconds at a temperature of between 1000° C. and 900° C., and coiling the strip at a temperature of between 550° C. and 700° C.;

(d) single-stage cold-rolling the strip of step (c) down to the final thickness; and (e) continuous decarburization annealing by annealing between 850 and 950° C., in a wet nitrogen-hydrogen atmosphere for a period of time of between 20 and 150 seconds to produce a primary recrystallized strip; and subsequently nitriding annealing at temperature between 900 and 1050° C., in a wet nitriding atmosphere comprising ammonia at a level of from 1 to 35 standard liters per kg. of strip and from 0.5 to 100 $g/m^3$ of water vapor.

2. Process according to claim 1, wherein the steel includes from 100 to 300 ppm of C, from 300 to 350 ppm of $Al_{sol}$ and from 60 to 900 ppm of N.

3. Process according to claim 1, wherein the steel may also contain other trace elements, selected from the group consisting of chromium, nickel and molybdenum, in a total amount not exceeding 3500 ppm.

4. Process according to claim 1, wherein the heating temperature of the slabs is between 1250° C. and 1300° C.

5. Process according to claim 1, wherein after a time interval of between 4 and 12 s. from the moment the strip comes out of the hot rolling mill, a water cooling phase of the strip begins.

6. Process according to claim 1, wherein the content of ammonia in the nitriding gas fed into the furnace is between 1 and 9 standard liters per kg. of steel.

7. Process according to claim 1, wherein the in the secondary-recrystallization treatment, the heating between 700° C. and 1200° C. takes place in a time period of at least 2 hours.

8. Process according to claim 7 wherein the heating between 700° C. and 1200° C. takes place in a time period of between 2 and 10 hours.

* * * * *